US007659675B2

(12) United States Patent
Kussel

(10) Patent No.: US 7,659,675 B2
(45) Date of Patent: Feb. 9, 2010

(54) DEVICE FOR ILLUMINATING THE STOPE SUPPORT AT A LONGWALL FACE

(75) Inventor: Willi Kussel, Werne (DE)

(73) Assignee: Tiefenbach Control Systems GmbH, Essen (DE)

( * ) Notice: Subject to any disclaimer, the term of this patent is extended or adjusted under 35 U.S.C. 154(b) by 488 days.

(21) Appl. No.: 10/554,979

(22) PCT Filed: Apr. 15, 2004

(86) PCT No.: PCT/DE2004/000779

§ 371 (c)(1),
(2), (4) Date: Sep. 21, 2006

(87) PCT Pub. No.: WO2004/097177

PCT Pub. Date: Nov. 11, 2004

(65) Prior Publication Data

US 2007/0052374 A1 Mar. 8, 2007

(30) Foreign Application Priority Data

May 2, 2003 (DE) ..... 103 19 934

(51) Int. Cl.
*H05B 37/00* (2006.01)

(52) U.S. Cl. ..... 315/318; 315/312; 315/294; 315/184; 315/185 R; 362/559; 362/555; 362/648; 362/227; 362/285

(58) Field of Classification Search ..... 315/184, 315/185 R, 186, 291, 294, 312, 362, 318; 362/555, 559, 570, 648, 227, 382, 431, 800, 362/285; 174/50
See application file for complete search history.

(56) References Cited

U.S. PATENT DOCUMENTS

| | | | | |
|---|---|---|---|---|
| 5,534,664 | A | 7/1996 | Fearing, Jr. et al. | |
| 6,184,628 | B1 * | 2/2001 | Ruthenberg | 315/185 R |
| 6,817,123 | B2 * | 11/2004 | Okazaki et al. | 40/452 |
| 2007/0217209 | A1 * | 9/2007 | Wong | 362/418 |

FOREIGN PATENT DOCUMENTS

| | | | |
|---|---|---|---|
| DE | 31 47 509 | C1 | 3/1983 |
| EP | 0 817 145 | A1 | 1/1998 |
| EP | 1 156 272 | A2 | 11/2001 |

OTHER PUBLICATIONS

International Search Report for International Appl. No. PCT/DE2004/000779, completed Sep. 10, 2004.
International Preliminary Report on Patentability for International Appl. No. PCT/DE2004/000779, issued Apr. 24, 2006.
Written Opinion for International Appl. No. PCT/DE2004/000779, mailed Sep. 17, 2004.

* cited by examiner

*Primary Examiner*—Haissa Philogene
(74) *Attorney, Agent, or Firm*—Alston & Bird LLP

(57) ABSTRACT

The light sources for illuminating the stope support at a longwall face are operated at low voltage, connected to the control network device, for low voltage supply of the system controllers. LEDs are particularly suitable as light sources. Measures for avoiding an impairment of the function of the system controllers are disclosed.

9 Claims, 5 Drawing Sheets

DEVICE FOR ILLUMINATING THE STOPE SUPPORT AT A LONGWALL FACE

BACKGROUND OF THE INVENTION

The invention relates to a device for the illumination of the stope supports in a longwall face. In the customary manner and necessary each stope support in a longwall face is provided with light sources by means of which the stope support and bordering longwall face can be illuminated. Since it must be assumed that a longwall face has 100 stope supports or more, it is obvious that the illumination of the stope supports requires a significant complexity which is made all the more difficult since, for reasons of safety technology, the power supply voltage for the illumination elements must be low in order to avoid sparking during switching.

The objective of the invention is to equip the device for the illumination of the stope supports with little complexity in such a manner that the device is safe.

BRIEF SUMMARY OF VARIOUS EMBODIMENTS

The special feature of this realization consists of the fact that the present equipment of the stope supports and the system controller is utilized and that in particular the supply lines carrying voltage and voltage transformers and, in given cases, rectifiers are superfluous. In this way the control power supply units required for the supply of power, which consist of voltage transformers and rectifiers and serve to supply power to the system controllers, are simultaneously also utilized to supply power to the light sources.

In this connection it is to be emphasized that, in the manner customary for the purposes supplying power, the system controllers are combined in groups, e.g. of three system controllers, and each group is supplied by one control power supply unit. This control power supply unit then also serves to supply power for illumination and in fact preferably to supply power for illuminating those stope supports whose system controllers are supplied by the control power supply unit.

In so doing, the invention makes use of the insight that, for one thing, the control power supply units must, for reasons of safety technology, have a nominal current which is substantially greater than the expected demand for power of the system controllers connected. This is associated with the peculiarity of the system controllers that, through the input of commands at a system controller, only the operation of one of its neighboring system controllers is possible so that the demand for power of the system controller serving to input the commands is, at most, low. According to the invention the free capacity of the control power supply unit is utilized to illuminate the system controller serving for the input of the commands and possibly also the system controllers operated. On the other hand, a simultaneous activation of all the system controllers connected to the same control power supply unit can be done by remote control or by automatic operation, i.e. without the presence of a human operator at the stope supports in question, so that illumination of these stope supports is not required. A special feature of the invention consists of the fact that the illumination is done only in the low-voltage range (no more that 60V) and preferably in a voltage range which also serves as the control voltage, e.g. 12 V.

The extension of the invention provides that LEDs, i.e. light-emitting diodes, are used as light sources, said LEDs today ensuring good illumination with white light and low demand for power. The use of the LEDs permits long-term operation of the light sources in the extension of the invention according to claim 3 without impairment of the illumination which, in given cases, would have to be accepted in the bargain with light sources which consume more power.

The extensions of the invention serves the purpose of always illuminating operated system controllers so that the process in the longwall face is always visible to the operator.

The extensions of the invention serve the purpose of avoiding an overload of the control power supply unit due to the demand for power of the light sources, even when control power supply units of relatively low nominal power are used with relatively low nominal current.

To avoid overloading the control power supply unit one provides, in the common supply line between the control power supply unit on one side and the individual system controller and the corresponding illumination on the other side, a current-limiting device through which the illumination is switched off on overshoot of a certain fixed maximum current or is throttled so that the power required for the system controller is always available and failure of the control power supply unit is not to be feared.

In the extension of the invention, on the one hand, an overload of the control power supply unit and, on the other hand, the shifting, or any other movement, of a stope support when a person is present is avoided. This is based on the insight that, when a person is present at a stope support, that stope support may not be pushed back so that, for reasons of safety, the system controller corresponding to the same stope support is locked and switched off during the switching of a light source. The illumination is therefore done when needed, i.e. when a person is present. In the development according to the claim, this switching on of the light source can be done by hand by the operator at the respective system controller or the associated stope support.

It can however also be done by presence detectors, e.g. motion detectors. In this case the presence detector has a double function, namely the switching on of the light source and the switching off of the system controller which an operator approaches.

In the development of the invention, on the one hand, complexity in the high-voltage system is avoided since the high-voltage system serving for the control power supply units is also utilized for illumination. On the other hand, the control power supply unit can be designed with weak nominal power and the long-term operation of the illumination in the entire longwall face, i.e. at all the stope supports, can be made possible by one light power supply unit. This light power supply unit is preferably combined with the control power supply unit.

The good illumination of a stope support also depends on the number of light sources. Through the extension of the invention the capability is provided of supplying a greater number of light sources from one control power supply unit or light power supply unit without increasing its nominal power or causing an increased demand for power which, in given cases, leads to the failure of the power supply unit or to the switching off of the illumination.

BRIEF DESCRIPTION OF THE SEVERAL VIEWS OF THE DRAWINGS

After the above heading, please insert the following.

DETAILED DESCRIPTION

Figure 1:
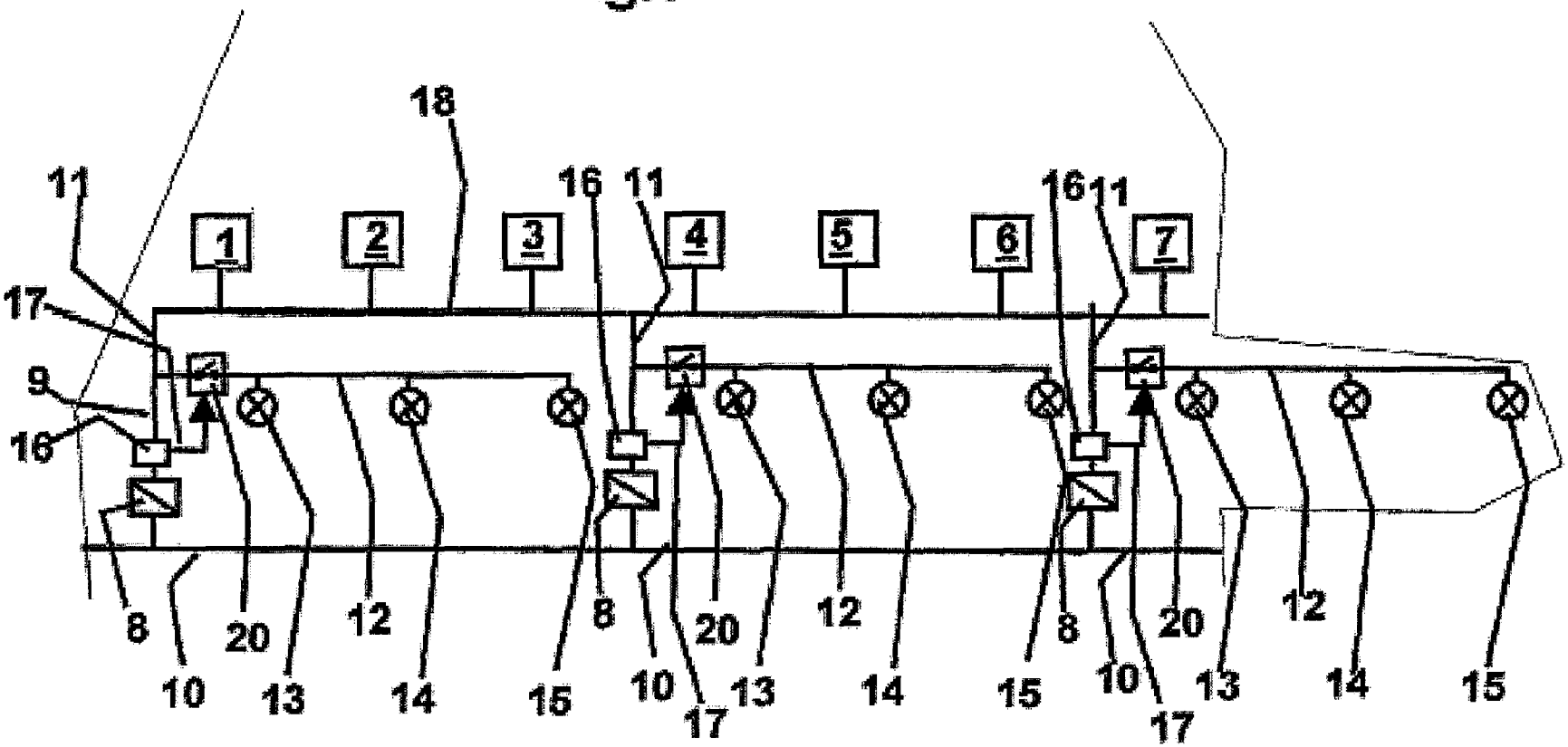
FIG. 1 depicts a longwall face in accordance with an exemplary embodiment of the present invention.

In the following the invention is described with the aid of embodiment examples and figures.

Out of the more than 100 stopes of a longwall face, only the system controllers 1 to 7 of the corresponding stope supports are represented in the FIGS. 1 to 4. These system controllers are supplied in groups of three per piece, e.g. 1-3 or 4-6, by a common control power supply unit 8. The control power supply unit 8 transforms the voltage of 220 V in the line 10 down to 12 DC V in the supply line 9. The control line 11, and simultaneously the light line 12 through which the three light sources 13, 14, and 15 are supplied, branch off from the supply line 9.

The system controller devices 1 to 7 are connected to one another via a bus line 18. Via the bus line 18 an activation of every single one of the system controllers 1 to 7 can occur, and in fact by command input at a central control room or at one of the neighboring system controllers. The current flowing in the supply line 9 is measured by a current-measuring device 16. The current-measuring device 9 switches, via the priority line 17, the priority switch 20 which is disposed before the light sources 13, 14, and 15. The priority switch 20 is switched on in normal operation and is switched off if, in the current-measuring device 16, a current is measured which exceeds the limit value defined as permissible. For example, the sum of the nominal current of the three light sources 13, 14, and 15 can be defined as a current limit value of this type. That would mean that the illumination of the light sources 13, 14, and 15 is switched off by means of a priority switch 20 as soon as one of the system controllers 1, 2, 3 or 4, 5, 6 etc. is activated, that is, has a need for power. The limit value in the current-measuring device 16 can however also be set higher, and in fact by the demand for power of two system controllers higher than the sum of the nominal current of three light sources or the illumination of three stope supports. Thereby the fact is taken into account that the system controllers provide a lock in the sense that the system controller is not actuated, and thus the assigned stope support cannot be pushed back or otherwise moved, if a person is in the area of the stope support, for example, an operator who gives control commands from the system controller. The locking therefore means in particular that from a system controller switching commands for the same stope support cannot be initiated. The circuit can also be embodied so that not all, but rather only a few, light sources are assigned, and can be switched off, by priority switches.

Conversely, the current measurement by the current-measuring device 16 can also be utilized to switch on a switch 20 which in this case takes the place of the priority switch 20. Thereby the light sources 13, 14, and 15 of three neighboring stope supports can be switched on if, at one of the system controllers which are assigned to these stope supports, power is being consumed, that is, there is an operation, a shifting, or other movement of a stope support there. In other respects FIG. 1, and the description corresponding thereto, also relates to such an embodiment. It is a prerequisite for this embodiment that the control power supply unit is designed to be so large that its nominal current exceeds the sum of all the consumers, i.e. system controllers and light sources, connected to the control power supply unit, as is the case in the embodiment according to FIG. 3. In the system controllers according to FIG. 2 each system controller 1, 2, 3, . . . , 7 is assigned a presence detector 21 with a switching device 22. If the presence detector responds, the relevant system controller is deactivated via the locking line 23 so that through the system controller the assigned stope support cannot be shifted or otherwise moved.

Figure 2:
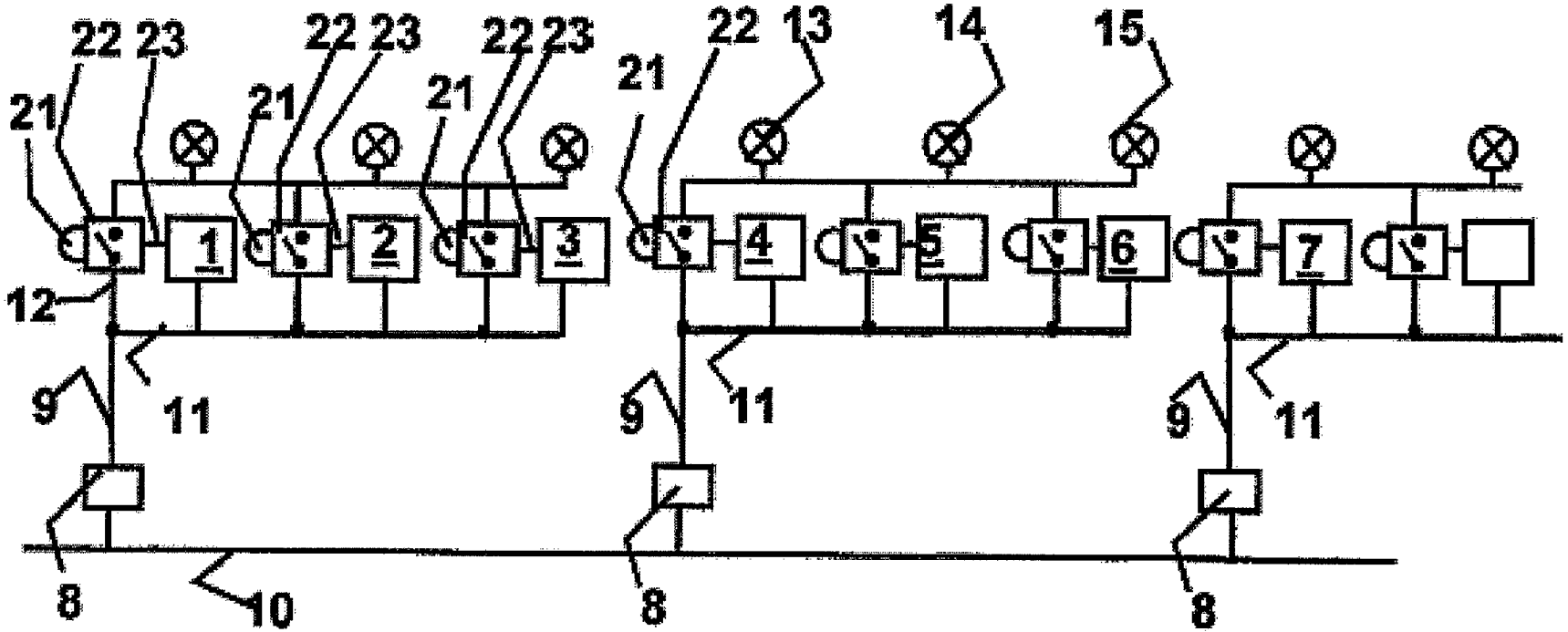
FIG. 2 depicts a longwall face in accordance with an exemplary embodiment of the present invention.

The light source 13 or 14 or 15 is switched on simultaneously. In FIG. 2 it is represented that through the light lines 12 the light sources 13, 14, and 15 of three neighboring stope supports can be switched on or off simultaneously if one of the presence detectors 21 responds. The presence detectors 21 register the presence of a person and, in the circuit according to FIG. 2, lead, on the one hand, to the illumination of three neighboring stope supports being switched on when a person is present in the area of the presence detector and, on the other hand, to the activation of the stope support in whose area the person is located being switched off.

Figure 3:
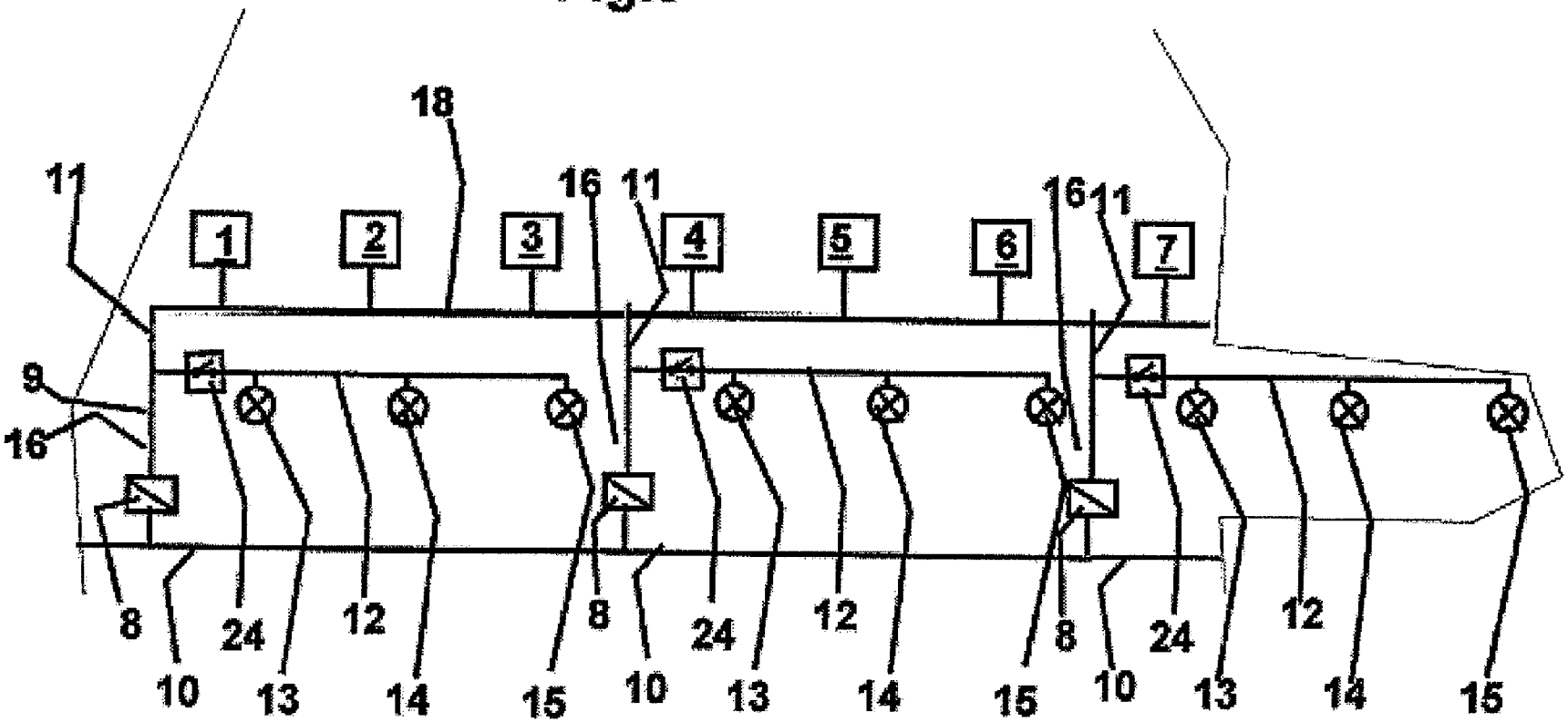
FIG. 3 depicts a longwall face in accordance with an exemplary embodiment of the present invention.

In the case of the device according to FIG. 3 no other measures for the priority power supply unit of the system controllers are provided. By the design of the power supply unit 11 it is ensured that the nominal current of each power supply is in any case greater than the sum of the maximum currents of all the system controllers and light sources which are supplied by the power supply unit. By switching a light switch 24 the light sources 13, 14, 15 of three neighboring stope supports can be switched on by hand or by remote control or automatically, depending on certain commands, if at one of the system controllers which are assigned to these stope supports power is being consumed, that is, there is an operation, a shifting, or other movement of a stope support.

Figure 4:
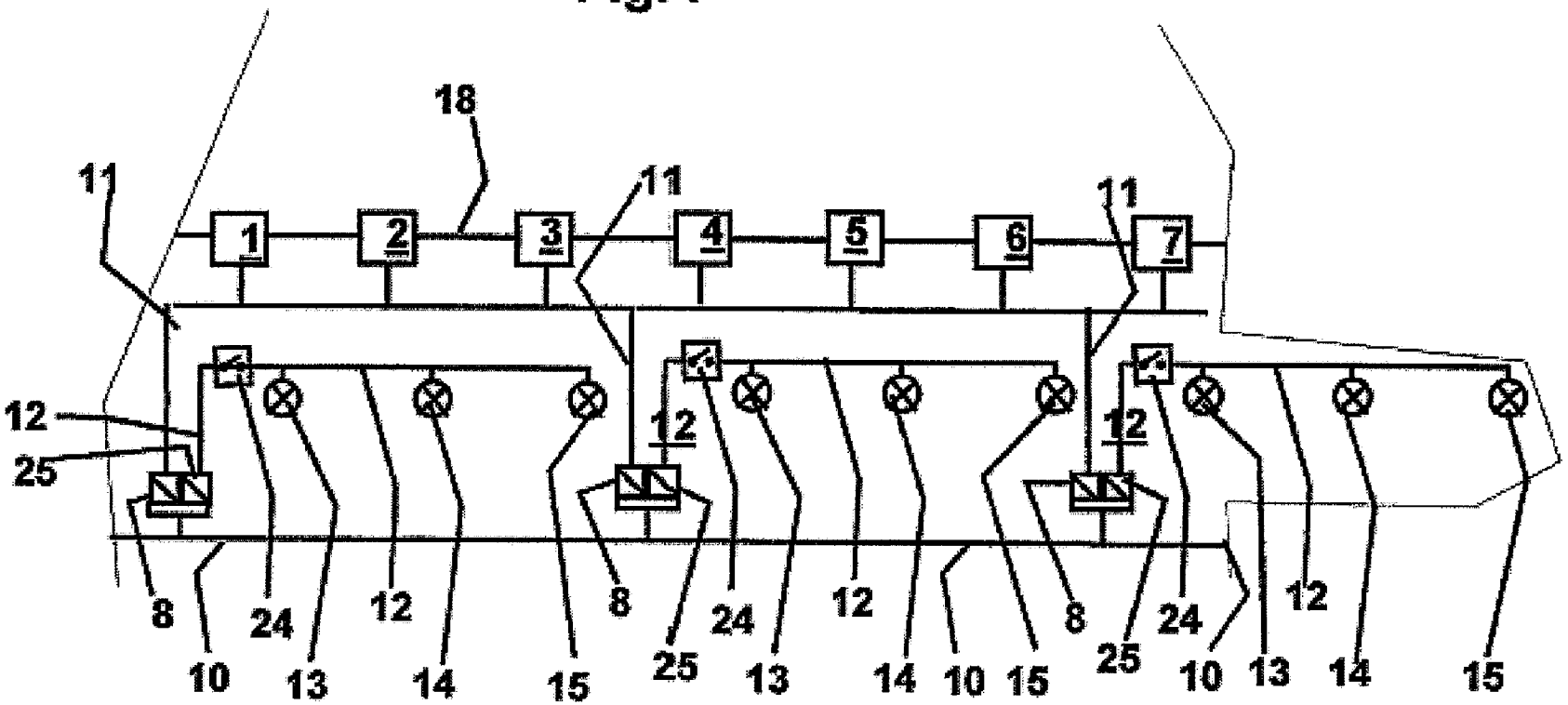
FIG. 4 depicts a longwall face in accordance with an exemplary embodiment of the present invention.

In the embodiment according of FIG. 4 also no measures for the priority switching of the system controllers are provided, but rather the power supplies are divided in two and consist of a control power supply unit 8 and an illumination power supply unit 25. The system controllers are supplied by the control power line 11 while the light power line 12 is connected to the illumination power supply unit. The advantage of this embodiment consists of the fact that in fact only one supply line 10 with high voltage, e.g. a 220V line, to both power supplies is required but the two power supplies can be designed with relatively low nominal current which must take into account only the demand for power of the system controllers on the one hand and the light sources on the other hand.

Figure 5:
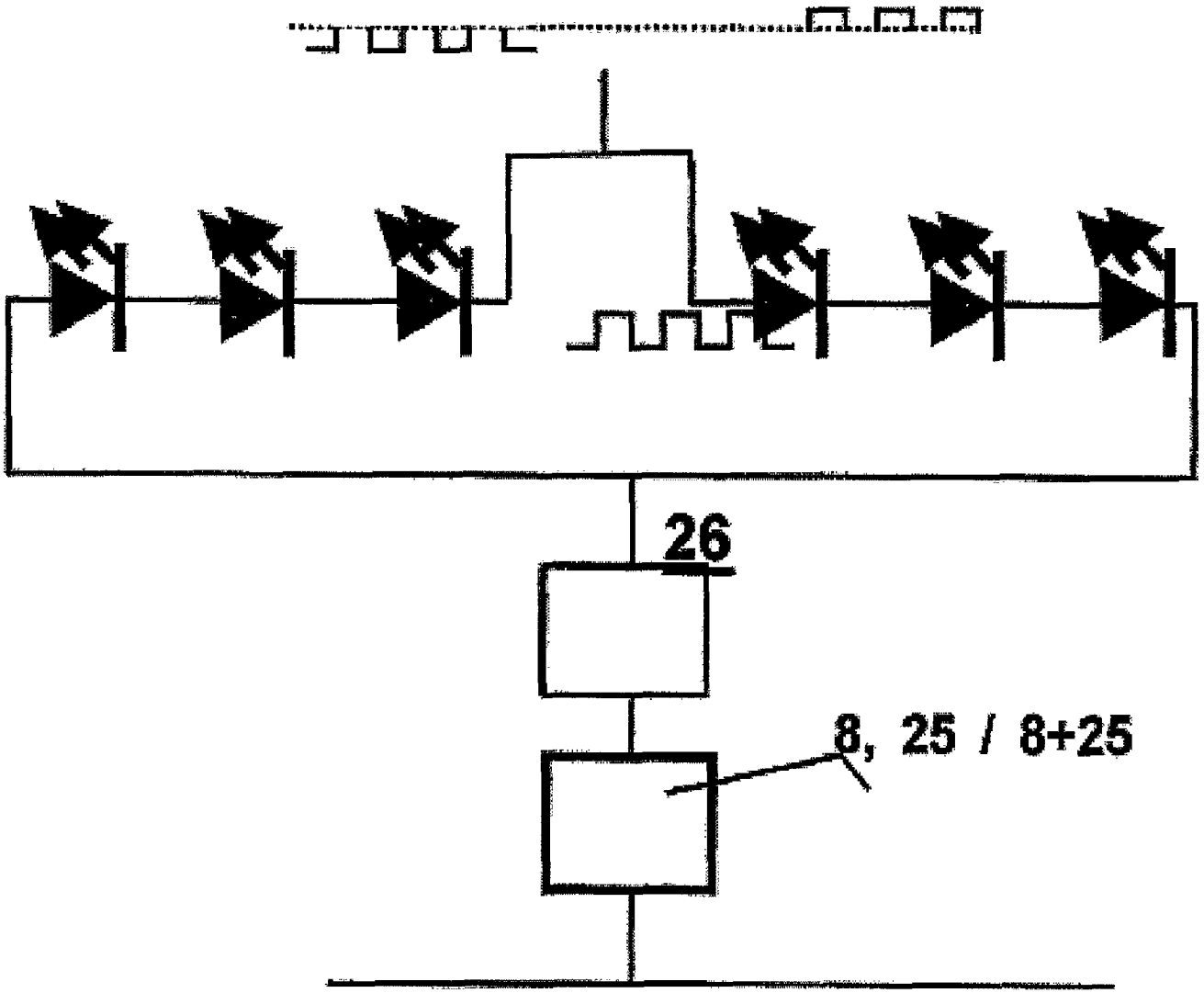
FIG. 5 depicts light sources in accordance with an exemplary embodiment of the present invention.

In FIG. 5 it is represented schematically that the light sources 13 or 14 or 15 each consist of several LEDs. Let it be noted that, in all the circuits according to FIGS. 1 to 4, this embodiment can replace the light sources 13, 14, 15 represented there.

It is furthermore represented that each light source 13, 14, 15 consists of two groups, each of the three LEDs. Both groups are supplied by a common light line 12, but with the interposition of an inverter 26 which generates an AC voltage. The one group of LEDs is for positive voltage and the other group for negative voltage. With the appropriate choice of the frequency, of e.g. 100 Hz, there is no influence of the quality of illumination here but possibly a better utilization of the electrical power available for illumination.

The invention claimed is:

1. A device for the illumination of stope supports in a longwall face, said device comprising:

light sources and system controller devices at each of the stope supports, and one control power supply unit for a limited number of system controllers to supply them with low voltage, wherein the light sources are connected to the control power supply units.

2. The device according to claim 1, wherein LEDs (light-emitting diodes) are provided as the light sources.

3. The device according to claim 1, wherein the switching on of the light sources of a stope support is done by presence detectors.

4. A device for the illumination of stope supports in a longwall face, said device comprising:

light sources and system controller devices at each of the stope supports, and one control power supply unit for a limited number of system controllers to supply them with low voltage, wherein the light sources are connected to the control power supply units, and wherein a current is measured at the output of the control power supply unit and on overshoot of a fixed minimum current the power supply of individual, or all, the connected light sources is switched on.

5. A device for the illumination of stope supports in a longwall face, said device comprising:

light sources and system controller devices at each of the stope supports, and one control power supply unit for a limited number of system controllers to supply them with low voltage, wherein the light sources are connected to the control power supply units, and wherein a current is measured at the output of the control power supply unit and on overshoot of a fixed minimum current the power supply of individual, or all, the connected light sources is interrupted or reduced.

6. A device for the illumination of stope supports in a longwall face, said device comprising:

light sources and system controller devices at each of the stope supports, and one control power supply unit for a limited number of system controllers to supply them with low voltage, wherein the light sources are connected to the control power supply units, and wherein with the switching on of the light sources of a stope support there is a switching off of the associated system controller.

7. A device for the illumination of stope supports in a longwall face, said device comprising:

light sources and system controller devices at each of the stope supports, and one control power supply unit for a limited number of system controllers to supply them with low voltage, wherein the light sources are connected to the control power supply units, and wherein the light sources which are connected to one control power supply unit have a nominal current which is not greater than the difference between the nominal current of the control power supply unit and the maximum current of the connected system controllers.

8. A device for the illumination of stope supports in a longwall face, said device comprising:

light sources and system controller devices at each of the stope supports, and one control power supply unit for a limited number of system controllers to supply them with low voltage, wherein the light sources are connected to the control power supply units, and wherein a light power supply unit is connected to the supply line to each of the control power supply units, where the control power supply unit for supplying power is assigned to each system controller, or a group of system controllers, and the light power supply unit is assigned to the light sources of a stope support or a group of stope supports.

9. A device for the illumination of stope supports in a longwall face, said device comprising:

light sources and system controller devices at each of the stope supports, and one control power supply unit for a limited number of system controllers to supply them with low voltage, wherein the light sources are connected to the control power supply units, and wherein the light sources which can be switched on simultaneously are divided into groups, wherein in the supply line for the light sources an AC generator is connected, and in the supply line between the AC generator and each of the groups a rectifier is connected, where the rectifiers of both groups are directed in opposite senses.

* * * * *

UNITED STATES PATENT AND TRADEMARK OFFICE

CERTIFICATE OF CORRECTION

PATENT NO. : 7,659,675 B2
APPLICATION NO. : 10/554979
DATED : February 9, 2010
INVENTOR(S) : Willi Kussel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 811 days.

Signed and Sealed this

Thirtieth Day of November, 2010

David J. Kappos

David J. Kappos
*Director of the United States Patent and Trademark Office*